US007124540B2

(12) United States Patent
Qiang

(10) Patent No.: US 7,124,540 B2
(45) Date of Patent: Oct. 24, 2006

(54) SEALING DEVICE

(76) Inventor: Mi Qiang, East to Wei Shu Village Committee, Feibei Road, 213023 Changzhou, P. R. (CN)

( * ) Notice: Subject to any disclaimer, the term of this patent is extended or adjusted under 35 U.S.C. 154(b) by 210 days.

(21) Appl. No.: 10/800,370

(22) Filed: Mar. 12, 2004

(65) Prior Publication Data

US 2005/0198909 A1 Sep. 15, 2005

(51) Int. Cl.
*F06B 7/16* (2006.01)
*F16J 15/02* (2006.01)

(52) U.S. Cl. ..... 49/492.1; 277/637; 277/937

(58) Field of Classification Search ..... 49/492.1, 49/475.1, 478.1, 495.1, 489.1, 493.1; 277/637, 277/640, 645, 650, 651, 652, 653, 654, 921, 277/737, 925, 630; 392/310; 219/391; 24/296, 24/458

See application file for complete search history.

(56) References Cited

U.S. PATENT DOCUMENTS 3,578,764 A * 5/1971 Nunnally et al. ..... 277/652
4,822,060 A * 4/1989 Moyer et al. ..... 277/640
4,986,033 A * 1/1991 Weil ..... 49/492.1
5,066,028 A * 11/1991 Weil ..... 277/640
5,107,623 A * 4/1992 Weil ..... 277/637
5,205,075 A * 4/1993 Moyer ..... 49/493.1
5,289,658 A * 3/1994 Lusen et al. ..... 49/492.1
5,341,601 A * 8/1994 Moyer ..... 49/493.1
6,533,289 B1 * 3/2003 Bono et al. ..... 277/652
6,893,025 B1 * 5/2005 Hight et al. ..... 277/630

* cited by examiner

*Primary Examiner*—Hugh B. Thompson, II
(74) *Attorney, Agent, or Firm*—Raymond Y. Chan; David and Raymond Patent Firm

(57) ABSTRACT

A sealing device includes an elongated sealing member and a plurality of fasteners spacedly mounted along the sealing member. The sealing member includes a tubular heat sealing layer and a tubular supporting frame, having a flexible ability, coaxially received in the heat sealing layer and defining a deformable channel within the supporting frame. Each of the fasteners has a retention base disposed within the deformable channel and a engagement head outwardly extended from the retention base through the supporting frame and the heat sealing layer in such a manner that the supporting frame and the heat sealing layer are sandwiched between the retention base of each of the fasteners and the engagement head thereof, so as to retain the supporting frame within the heat sealing layer in position.

11 Claims, 5 Drawing Sheets

SEALING DEVICE

BACKGROUND OF THE INVENTION

1. Field of Invention

The present invention relates to gaskets, and more particularly to a sealing device for a thermal device, which is adapted to fasten with a door of the thermal device to sealedly enclose the thermal chamber therein.

2. Description of Related Arts

A thermal appliance, such as oven, generally generates heat within a thermal chamber therein, wherein the thermal appliance comprises a container body and a door pivotally mounted to the container body to form the thermal chamber within the container body and the door. In order to prevent the heat from escaping the thermal chamber through the gap between the container door and the door, a gasket is typically used to mount on the door to seal the gap.

A conventional gasket is made of rubber and is securely fastened at the perimeter of the door such that when the door is pivotally folded to close the container body, the gasket is sealedly sandwiched between the door and the container body so as to sealedly enclose the thermal chamber. However, the conventional gasket has several drawbacks.

Since the gasket is made of rubber, the gasket provides a predetermined elasticity to seal the gap between the container body and the door. However, since the thermal appliance generates a relatively high temperature within the thermal chamber, such as 350° C. to 500° C., the rubber made gasket will gradually be deformed after a period of time usage. Once the elasticity of the gasket is reduced, the gasket cannot effectively seal the gap between the container body and the door such that the heat is started to escape from the thermal chamber to outside through the gap. Therefore, the gasket must be replaced after of period of time usage.

U.S. Pat. No. 5,107,623, owned by Weil, generally suggests an improved gasket, as shown in FIG. 1, which comprises an outer jacket 1A woven around an elongated core 1B and a plurality of fasteners 1C spacedly formed along the outer jacket 1A, wherein each of the fasteners 1C has a base portion 11C disposed between the outer jacket 1A and the elongated core 1B and an engagement portion 12C extended outwardly from the base portion 11C through the outer jacket 1A. Therefore, the gasket is adapted to mount at the perimeter of the door by respectively inserting engagement portion 12C of the fasteners 1C into fastening holes spacedly formed along the perimeter of the door.

Accordingly, the elongated core 1B is made of metal wire to retain the shape of the outer jacket 1A. However, since the base portion 11C of each of the fasteners 1C is mounted between the elongated core 1B and the outer jacket 1A, the fasteners 1C cannot substantially support the total weight of the elongated core 1B and the outer jacket 1A after a period of time usage. Therefore, the outer jacket 1A will be gradually deformed due to the weight of the elongated core 1B, as shown in FIG. 1. In other words, the outer jacket 1A will be torn easily along the split that the engagement portion 12C of the fastener 1C extended therethrough. Such gasket losses the heat resistance ability when the outer jacket 1A is broken.

In addition, the manufacturing process of such gasket is complicated since each of the fasteners 1C must be precisely mounted along the gasket at a position that the base portion 11C of each of the fasteners 1C is sandwiched between the outer jacket 1A and the elongated core 1B. Therefore, the complicated structure of such gasket not only increases the manufacturing cost thereof but also is disadvantage in practice use.

SUMMARY OF THE PRESENT INVENTION

A main object of the present invention is to provide a sealing device, which is adapted to fasten with a door of the thermal device to sealedly enclose the thermal chamber therein.

Another object of the present invention is to provide a sealing device, which comprises a tubular heat sealing layer, a tubular supporting frame coaxially received therein, and a plurality of fasteners not only provides a substantial attachment between the heat sealing layer and the supporting frame but also securely mounts the heat sealing layer along the perimeter of the door of the thermal device.

Another object of the present invention is to provide a sealing device, wherein each of the fasteners is mounted on the door of the thermal device, the fastener provides a clipping force to substantially mount the heat sealing layer on the supporting frame. In other words, the fastener functions not only as a regular fastener to mount the heat sealing layer on the door of the thermal but also as a snap fastener to retain the supporting frame in position.

Another object of the present invention is to provide a sealing device, wherein each of the fasteners has a spiral retention base constructed by a bent wire such that the fastener can be easily mounted to the supporting frame by simply turning the retention base into the supporting frame.

Another object of the present invention is to provide a sealing device, which does not require altering the original simple structure of the sealing device so as to reduce the manufacturing cost of the heat sealing layer incorporating with the fasteners.

Another object of the present invention is to provide a sealing device, wherein no expensive or complicated structure is required to employ in the present invention in order to achieve the above mentioned objects. Therefore, the present invention successfully provides an economic and efficient solution not only for providing a simple configuration for sealing the gap of the thermal but also for enhancing the practice use of the present invention.

Accordingly, in order to accomplish the above objects, the present invention provides a sealing device, comprising:

an elongated sealing member, comprising a tubular heat sealing layer and a tubular supporting frame, having a flexible ability, coaxially received in the heat sealing layer and defining a deformable channel within the supporting frame; and a plurality of fasteners spacedly mounted along the sealing member, wherein each of the fasteners has a retention base disposed within the deformable channel and a engagement head outwardly extended from the retention base through the supporting frame and the heat sealing layer in such a manner that the supporting frame and the heat sealing layer are sandwiched between the retention base of each of the fasteners and the engagement head thereof, so as to retain the supporting frame within the heat sealing layer in position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
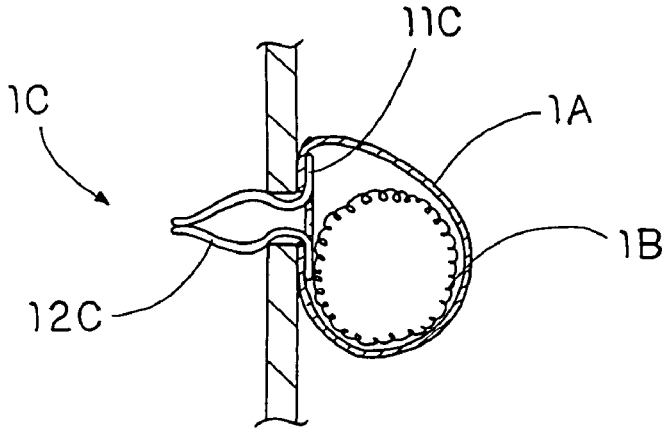
FIG.1 PRIOR ART
FIG. 1 is a sectional view of a conventional gasket.
Figure 2:
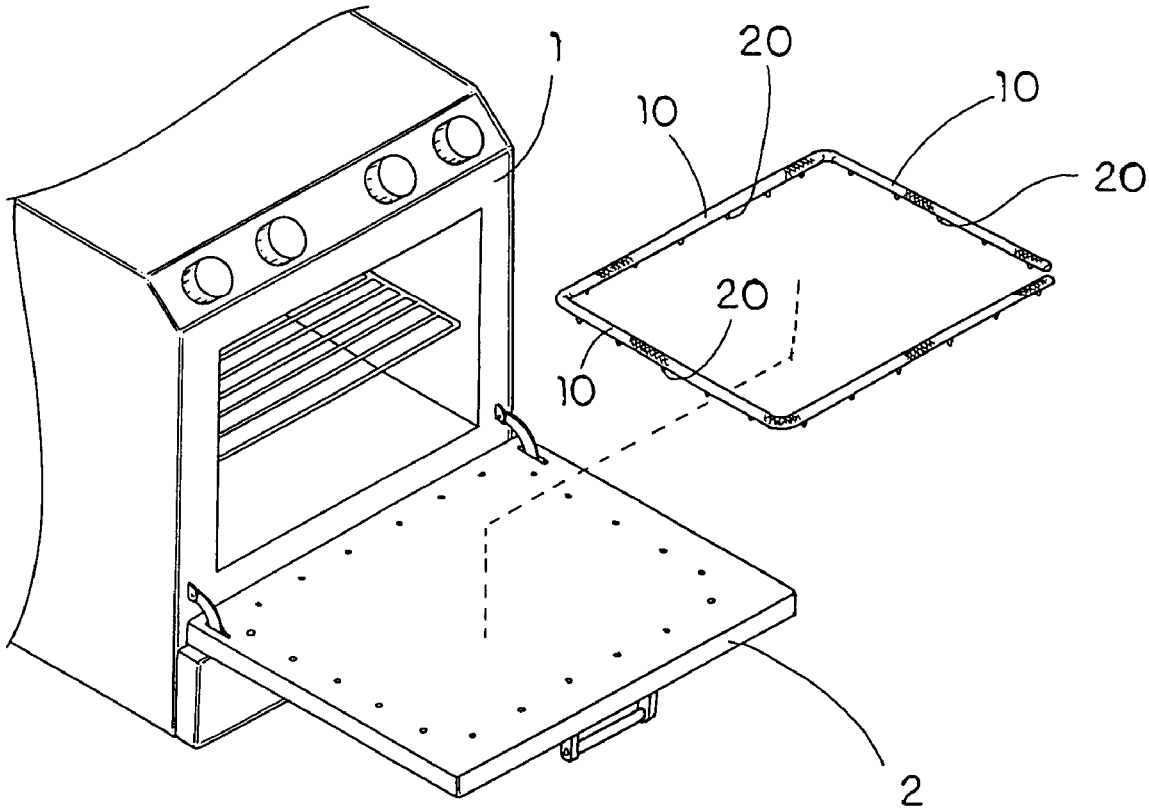
FIG. 2 is a perspective view of a sealing device incorporated with a thermal device according to a preferred embodiment of the present invention.
Figure 3:
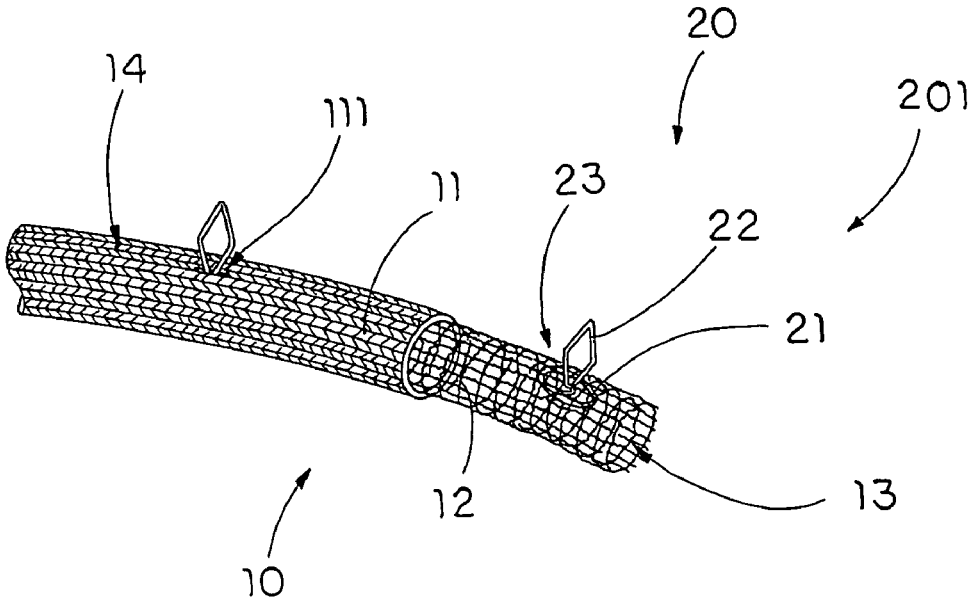
FIG. 3 is a perspective view of the sealing device according to the preferred embodiment of the present invention.

Referring to FIGS. 2 and 3 of the drawings, a sealing device according to a preferred embodiment of the present invention is illustrated, wherein the sealing device is adapted for incorporating with a thermal device having a container body 1 and a door 2 operatively connected with the container body 1 so as to seal a gap between a container body 1 and the door 2.

As shown in FIG. 3, the sealing device comprises an elongated sealing member 10 and a fastening means for fastening the sealing member 10 along the perimeter of the door 2 of the thermal device.

The sealing member 10 comprises a tubular heat sealing layer 11 and a tubular supporting frame 12, having a flexible ability, coaxially received in the heat sealing layer 11 and defining a deformable channel 13 within the supporting frame 12.

The fastening means comprises a plurality of fasteners 20 spacedly mounted along the sealing member 10, wherein each of the fasteners 20 has a retention base 21 disposed within the deformable channel 13 and an engagement head 22 outwardly extended from the retention base 21 through the supporting frame 12 and the heat sealing layer 11 in such a manner that the supporting frame 12 and the heat sealing layer 11 are sandwiched between the retention base 21 of each of the fasteners 20 and the engagement head 22 thereof, so as to retain the supporting frame 12 within the heat sealing layer 11 in position.

According to the preferred embodiment, the heat sealing layer 11 is made of fiber glass yarns interwoven to enclose the supporting frame 12. Accordingly, the fiber glass yarns have high heat resistance ability such that when the heat sealing layer 11 is mounted between the container body 1 of the thermal device and the door 2 thereof, the heat sealing layer 11 is adapted for sealing the gap to sealedly enclose the chamber within the container body 1.

The heat sealing layer 11 further has a plurality of guiding split 111 spaced formed thereon for the engagement heads 22 of the fasteners 20 extending through respectively.

The supporting frame 12 is made of heat resisting material for preventing the distortion of the supporting frame 12 when heat is applied. The supporting frame 12 is constructed by at least a stainless steel yarn crocheted to form the tubular structure wherein a diameter of the supporting frame 12 is smaller than that of the heat sealing layer 11 such that the supporting frame 12 is fittingly disposed within the heat sealing layer 11.

Accordingly, the stainless steel yarn has a diameter from 0.13 mm to 0.15 mm such that the stainless steel yarn is crocheted to form the supporting frame 12 having a diameter from 6 mm to 30 mm. It is worth to mention that the stainless steel yarn is heated treated to enhance the heat resistance ability of the supporting frame 12. In addition, supporting frame 12 has a predetermined flexibility and is adapted to be pressed to deform the deformable channel 13 therewithin.

Figure 4:
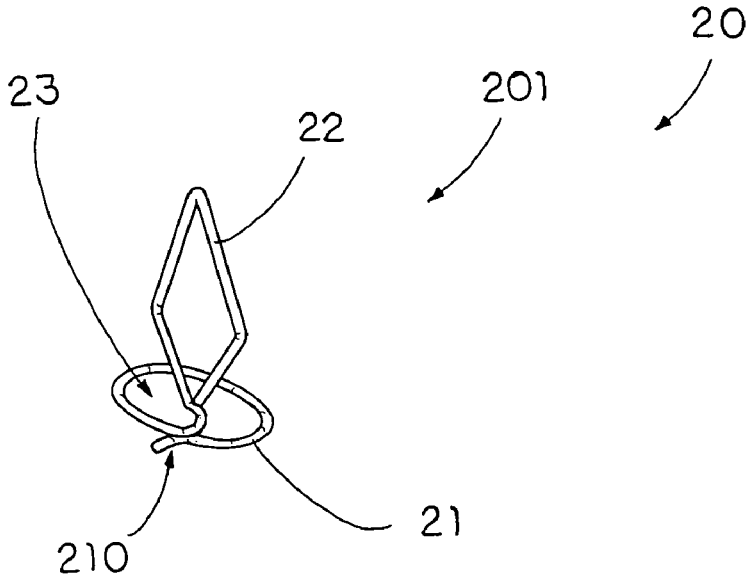
FIG. 4 is a perspective view of a fastener of the sealing device according to the preferred embodiment of the present invention.

As shown in FIG. 4, each of the fasteners 20 is made of a stiff metal wire spring 201, such as stainless steel, wherein the wire spring 201 has a first end portion bent to form the retention base 21 and a second end portion bent to form the engagement head 22. Therefore, the retention base 21 of each of the fasteners 20 is penetrated through the supporting frame 12 into the deformable channel 13.

Accordingly, the first end portion of the wire spring 201 is bent to a spiral shape of the retention base 21 such that a first free end of the first end portion of the wire spring 201 is turned to guide the retention base 21 of the fastener 20 into the deformable channel 13 of the sealing member 10 so as to securely mount the fastener 20 to the sealing member 10. In addition, the first free end 210 of the wire spring 201 is bent downwardly such that the first free end 210 of the retention base 21 of the wire spring 201 is adapted to easily penetrate through the supporting frame 12 into the deformable channel 13.

The second end portion of the wire spring 201 is bent to a diamond shape of the engagement head 22 to form a narrow neck portion 23 between the engaging head 22 and the retention base 21 wherein the supporting frame 12 and the heat sealing layer 11 are retained at the neck portion 23 of each of the fasteners 20. In other words, each of the fasteners 20 forms as a snap fastener to clip the supporting frame 12 with the heat sealing layer 11, so as to retain the supporting frame 12 within the heat sealing layer 11 in position.

Figure 5:
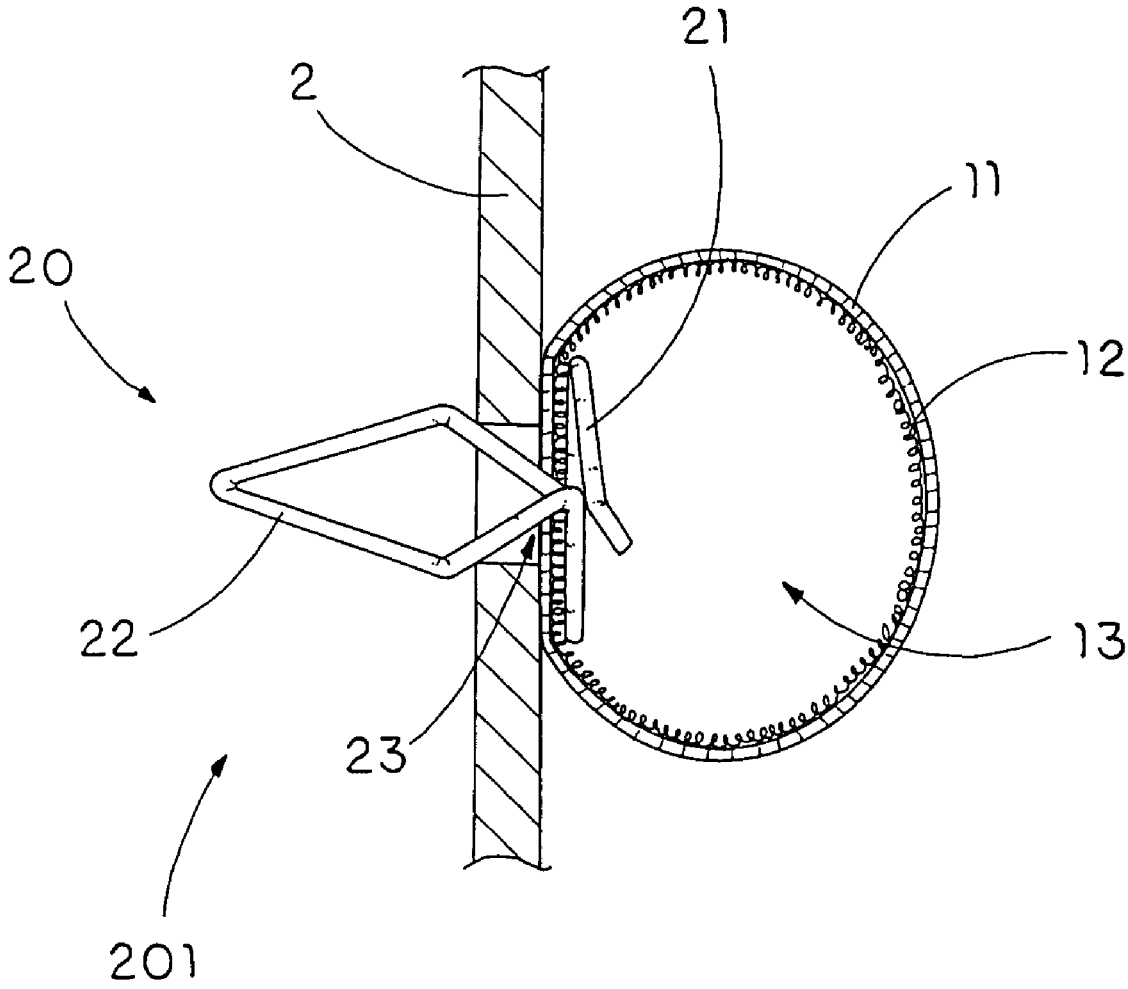
FIG. 5 is a sectional view of the sealing device according to the preferred embodiment of the present invention.

As shown in FIG. 5, the sealing member 10 is mounted to the door 2 of the thermal device by inserting the engagement heads 22 of the fasteners 20 into a mounting hole on the door 2. Once the engagement head 22 of each fastener 20 is inserted into the respective mounting hole, the retention base 21 of each of the fasteners 20 is forced to press towards the door 2 such that the heat sealing layer 11 and the supporting frame 12 are substantially sandwiched between the door 2 and the retention base 21 of the fastener 20. It is worth to mention that since the retention base 21 is disposed within the deformable channel 13 of the sealing member 10, the supporting frame 12 is also supported by the fasteners 20 to retain the supporting frame 12 in position. In other words, the weight of the supporting frame 12 is supported by the fasteners 20 to prevent the distortion of the heat sealing layer 11 after a period of time usage. It is worth to mention that the sealing member 10 has a predetermined length adapted to be adjustably cut to form a loop for fitting the perimeter of the door 2 of the thermal device.

The sealing member 10 further has a pigment layer 14 coated on an outer circumferential side of the heat sealing member 11. Accordingly, the pigment layer 14 can be made of molybdenum disulfide, graphite, silicone resin or other non-toxic substance for enhancing the appearance of the sealing member 10.

Figure 6:
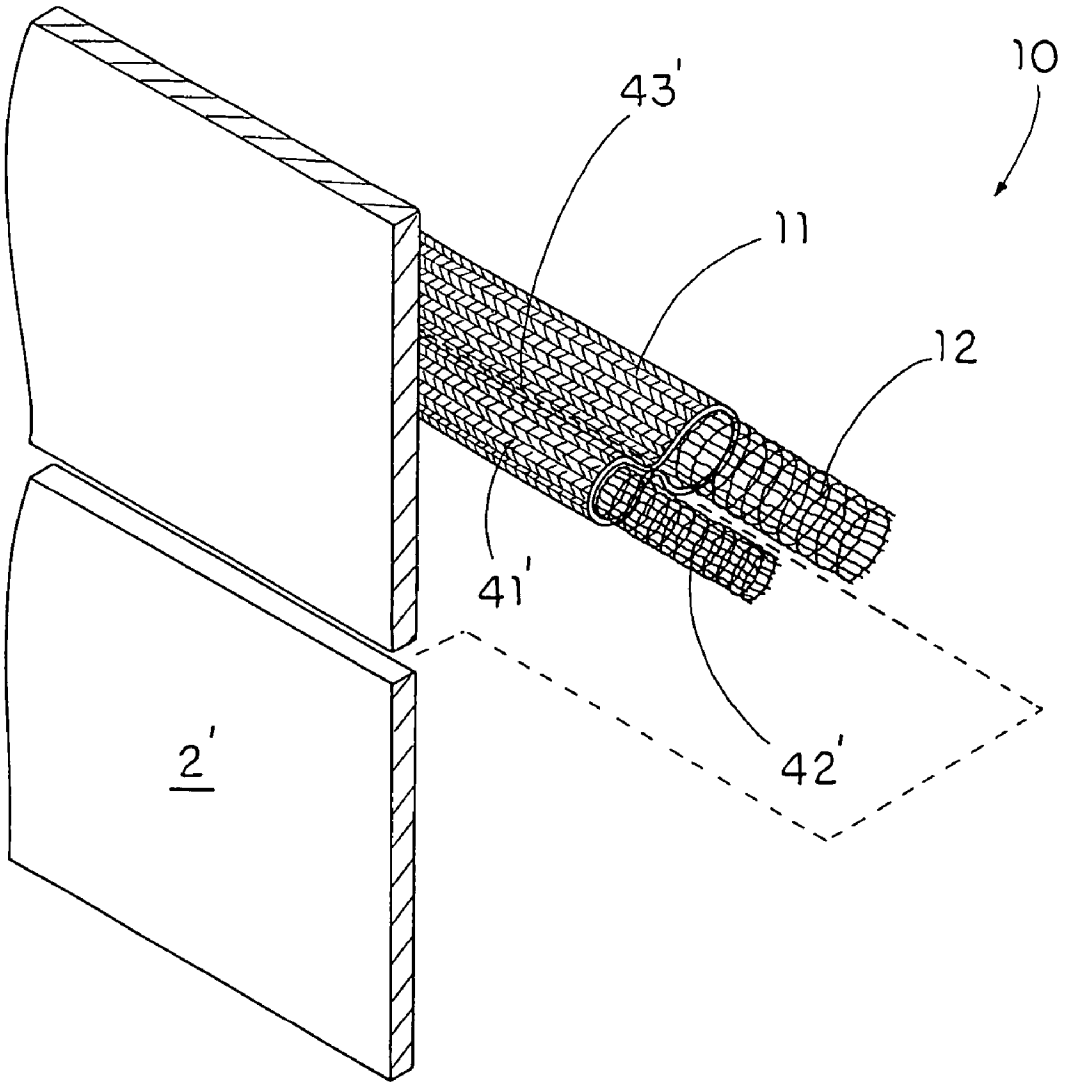
FIG. 6 is a first alternative mode of the fastening means of the sealing device according to the above preferred embodiment of the present invention.
Figure 7:
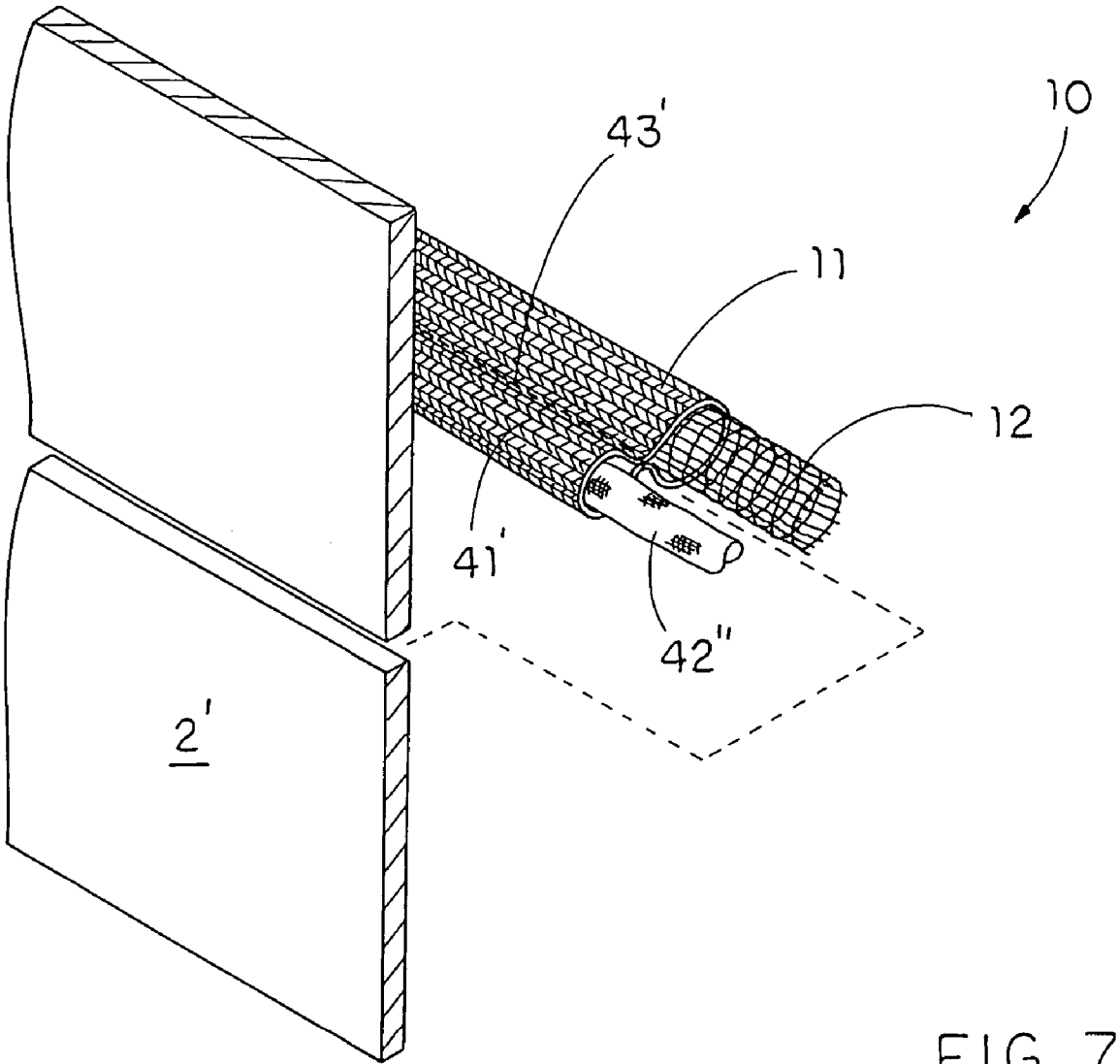
FIG. 7 is a second alternative mode of the fastening means of the sealing device according to the above preferred embodiment of the present invention.

FIG. 6 illustrates a first alternative mode of the fastening means which comprises a tubular fastening holder 41' longitudinally extended along the heat sealing layer 11 and a retaining element 42' received within the fastening holder 41' such that the fastening holder 41' is adapted to slidably receive in a mounting groove of the door 2' to retain the retaining element 42' therewithin, so as to securely mount the sealing member 10 to the door 2'.

As shown in FIG. 6 the fastening holder 41' is integrally extended from the heat sealing layer 11 to form a one piece integral tubular holder wherein the supporting frame 12 and the retaining element 42' are received in the tubular holder side by side. Accordingly, the fastening means further comprises a divider 43' longitudinally affixed on the tubular holder to the tubular holder divide into the heat sealing layer 11 and the fastening holder 41' to receive the supporting frame 12 and the retaining element 42' respectively. The divider 43' can be a continue stitch formed on the tubular holder to divide the tubular holder into the heat sealing layer 11 and the fastening holder 41'.

The retaining element 42' comprises a tubular wire spring which is made of stainless steel and is slidably received in the fastening holder 41' wherein the tubular wire spring is made of at least a stainless wire yarn crocheted for providing a spring force against the fastening holder 41' with respect to the mounting groove. In other words, the retaining element 42' has the same structural design of the supporting frame 12 such that the tubular wire spring of the retaining element 42' is adapted to be compressed to retain the sealing member 10 in shape, as shown in FIG. 6. It is worth to mention that the diameter of the supporting frame 12 should be larger than that of the tubular wire spring of the retaining element 42' since the retaining element 42' is designed to fit into the mounting groove for applying an urging force thereto so as to substantially hold the sealing member 10 on the door 2' in position.

Alternative, the retaining element 42" comprises an elongated bendable member slidably received in the fastening holder 41' such that when the fastening holder 41' is received in the mounting groove of the door 2', the bendable member of the retaining element 42" is disposed within the mounting groove and is adapted to be bent to retain the sealing member 10 in shape, so as to mount the sealing member 10 on the door 2'. Accordingly, the bendable member can be an elongated metal wire made of stainless steel or an elongated rope made of fiber glass.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sealing device, comprising:

an elongated sealing member, comprising a tubular heat sealing layer and a tubular supporting frame, having a flexible ability, coaxially received in said heat sealing layer and defining a deformable channel within said supporting frame; and a plurality of fasteners spacedly mounted along said sealing member, wherein each of said fasteners is made of a stiff metal wire spring having a first end portion bent to form a single spiral retention base, a second end portion bent to form an engagement head, and a curved narrow neck portion between said first end portion and said second end portion, wherein said retention base is disposed within said deformable channel and said engagement head is outwardly extended to an exterior of said sealing member through said supporting frame, wherein said supporting frame and said heat sealing layer are retained at said neck portion of each of said fasteners in position and are sandwiched between said retention base of each of said fasteners and said engagement head thereof so as to retain said supporting frame within said heat sealing layer in position.

2. The sealing device, as recited in claim 1, wherein said second end portion of said wire spring is bent to a diamond shape of said engagement head to form said neck portion between said engaging head and said retention base, wherein said neck portion of each of said fasteners has a height corresponding to a thickness of said sealing member so as to hold said supporting frame and said heat sealing layer between said engagement head and said retention base in position.

3. The sealing device, as recited in claim 2, wherein said retention base of each of said fasteners has a flat surface arranged to flatten a portion of said sealing member while said sealing member is retained at said neck portion of said respective fastener.

4. The sealing device, as recited in claim 3, wherein said sealing member further has a plurality of guiding splits spacedly formed thereon, wherein said retention base of each of said fasteners is twisted into said deformable channel through one of said guiding splits.

5. The sealing device, as recited in claim 4, wherein each of said guiding splits is formed at said heat sealing layer such that said retention base of each of said fasteners is slidably passed through said respective guiding split into said deformable channel through said supporting frame.

6. The sealing device, as recited in claim 5, wherein said sealing member further has a pigment layer coated on an outer circumferential side of said heat sealing member.

7. The sealing device, as recited in claim 1, wherein said sealing member further has a plurality of guiding splits spacedly formed thereon, wherein said retention base of each of said fasteners is twisted into said deformable channel through one of said guiding splits.

8. The sealing device, as recited in claim 7, wherein each of said guiding splits is formed at said heat sealing layer such that said retention base of each of said fasteners is slidably passed through said respective guiding split into said deformable channel through said supporting frame.

9. The sealing device, as recited in claim 1, wherein said sealing member further has a pigment layer coated on an outer circumferential side of said heat sealing member.

10. The sealing device, as recited in claim 6, wherein said supporting frame comprises at least a heat treated stainless steel yarn crocheted to form a tubular structure, wherein said heat sealing layer is made of fiber glass yarns interwoven to enclose said supporting frame.

11. The sealing device, as recited in claim 1, wherein said supporting frame comprises at least a heat treated stainless steel yarn crocheted to form a tubular structure, wherein said heat sealing layer is made of fiber glass yarns interwoven to enclose said supporting frame.

* * * * *